US005439412A

United States Patent [19]

Bishop

[11] Patent Number: 5,439,412

[45] **Date of Patent: * Aug. 8, 1995**

[54] MACHINE FOR USE IN THE MANUFACTURE OF POWER STEERING VALVES

[75] Inventor: Arthur E. Bishop, Sydney, Australia

[73] Assignee: A.E. Bishop Associates PTY Limited, North Ryde, Australia

[ * ] Notice: The portion of the term of this patent subsequent to Apr. 5, 2011 has been disclaimed.

[21] Appl. No.: 50,327

[22] PCT Filed: Oct. 28, 1991

[86] PCT No.: PCT/AU91/00495

§ 371 Date: May 19, 1993

§ 102(e) Date: May 19, 1993

[87] PCT Pub. No.: WO92/10334

PCT Pub. Date: Jun. 25, 1992

[30] Foreign Application Priority Data

Dec. 10, 1990 [AU] Australia ..... PK3787

[51] Int. Cl.[6] ..... B24B 19/02; B24B 5/36

[52] U.S. Cl. ..... 451/227; 451/252; 451/49

[58] Field of Search ..... 51/97 R, 238 R, 238 S, 51/238 GG, 105 VG, 94 R, 94 LS, 105 SP, 289 R; 451/49

[56] References Cited

U.S. PATENT DOCUMENTS

| | | | |
|---|---|---|---|
| 3,022,772 | 2/1962 | Ziegler et al. | 121/41 |
| 3,377,752 | 4/1968 | Border, Jr. | 51/238 |
| 3,425,168 | 2/1969 | Porath | 51/238 R |
| 3,449,867 | 10/1966 | Lindsay et al. | 51/238 R |
| 4,195,448 | 4/1980 | Check et al. | 51/165.77 |
| 4,766,703 | 8/1988 | Rattazzini | 51/289 R |
| 5,237,780 | 8/1993 | Lessway | 51/238.5 |
| 5,299,388 | 4/1994 | Bishop | 51/97 R |
| 5,319,916 | 6/1994 | Ritt et al. | 51/237 R |

*Primary Examiner*—Bruce M. Kisliuk
*Assistant Examiner*—Eileen Morgan
*Attorney, Agent, or Firm*—Nikaido, Marmelstein, Murray & Oram

[57] ABSTRACT

A machine for grinding the metering edge contours on edges of axially extending grooves of a power steering valve input-shaft by means of a cylindrical grinding wheel, the machine being constructed to hold and rotate the input-shaft and to increase and decrease cyclically the distance between the axis of the input-shaft and the grinding wheel several times during the revolution of the input-shaft to grind metering edge contours to produce symmetrical sets of clockwise and anticlockwise metering edge contours. The input-shaft is centrelessly supported by means of surfaces tangentially contacting the outside diameter of the input-shaft. Two such surfaces are axially displaced on either side of the ends of the grooves in the input-shaft and are arranged one on each side of the grinding wheel on that side of the input shaft adjacent the grinding wheel. Other of the support surfaces are arranged substantially at right angles to the first two support surfaces to constrain the input-shaft against motion in a direction parallel to the first two support surfaces. A pair of pressing members contacts the outside diameter of the input-shaft one each displayed axially on either side of the ends of the grooves and loaded so as to press the input-shaft in a direction generally towards the first two support surfaces.

3 Claims, 5 Drawing Sheets

MACHINE FOR USE IN THE MANUFACTURE OF POWER STEERING VALVES

FIELD OF THE INVENTION

This invention relates to apparatus for manufacturing fluid control contours in Components of rotary valves such as used in hydraulic power steering gears for vehicles. Such rotary valves include an input-shaft which incorporates in its outer periphery a plurality of blind-ended, axially extending grooves separated by lands. Journalled on the input-shaft is a sleeve having in its bore an array of axially extending blind-ended slots matching the grooves in the input-shaft, but in underlap relationship thereto, the slots of the one being wider than the lands of the other so defining a set of axially extending orifices which open and close when relative rotation occurs between the input-shaft and the sleeve from the centred or neutral condition, the magnitude of such rotation henceforth referred to as the valve operating angle. The edges of the input-shaft grooves are contoured so as to provide a specific orifice configuration often referred to as metering. These orifices are ported as a network such that they form sets of hydraulic Wheatstone bridges which act in parallel to communicate oil between the grooves in the input-shaft and the slots in the sleeve, and hence between an engine driven oil pump, and right-hand and left-hand hydraulic assist cylinder chambers incorporated in the steering gear, thereby determining the valve pressure characteristic.

BACKGROUND OF THE INVENTION

The general method of operation of such rotary valves is well known in the art of power steering design and so will not be described in any greater detail in this specification. A description of this operation is contained in U.S. Pat. No. 3,022,772 (Zeigler), commonly held as being the "original" patent disclosing the rotary valve concept.

Such rotary valves are nowadays regularly incorporated in firewall-mounted rack and pinion steering gears and, in this situation, any noises such as hiss emanating from the valve are very apparent to the driver. Hiss results from cavitation of the hydraulic oil as it flows in the orifices defined by the input-shaft metering edge contours and the adjacent edges of the sleeve slots, particularly during times of high pressure operation of the valve such as during vehicle parking manoeuvres. It is well known in the art of power steering valves that an orifice is less prone to cavitation if the metering edge contour has a high aspect ratio of width to depth, thereby constraining the oil to flow as a thin sheet of constant depth all along any one metering edge contour. Similarly it is important that the flow of oil divides equally amongst the aforementioned network of orifices, so further effectively increasing the above aspect ratio. This requires highly accurate angular spacing of the input-shaft metering edge contours as well as the precision of manufacture of each metering edge contour to ensure uniformity of depth along their length. Precision is most important in that portion of the metering edge contour controlling high pressure operation of the rotary valve associated with parking manoeuvres, where the pressure generated is typically 8 MPa and the metering edge contour depth only about 0.012 mm. This portion lies immediately adjacent to the outside diameter of the input-shaft, and is associated with the maximum normal operating angle of the valve. However precision is also required in order to avoid hiss further down the metering edge contour where the pressure generated is typically 2 MPa and the contour depth about 0.024 mm. The remainder of the metering edge contour towards the centred position of the rotary valve is important in determining the valve pressure characteristic, but not valve noise.

It is also well known that cavitation is less likely to occur if the metering edge contour is of a wedge configuration having a slope of no more than about 1 in 12 with respect to the outside diameter of the input-shaft. The low slope of the metering edge contour in the parking region makes it difficult to achieve the above-mentioned highly accurate angular spacing of the metering edge contours, the latter spacing which controls valve operating angle and hence, not only valve noise, but also the steering gear parking efforts.

Several manufacturers seek to achieve the above described accuracy by grinding metering edge contours in special purpose chamfer grinding machines in which the input-shaft is supported on centres previously used for cylindrically finish grinding its outside diameter. Such machines have a large diameter grinding wheel, of a width equal to the axial extent of the metering edge contours, which is successively traversed across the edge of each input-shaft groove thereby producing a series of flat chamfers. In some cases each metering edge contour is constructed from a number of flat chamfers, usually one, two or even three flat chamfers per metering edge contour requiring, for example, as many as 36 separate traverses of the grinding wheel to manufacture the metering edge contours of a six slot input-shaft. Such a manufacturing method is therefore time consuming and expensive.

Other manufacturers adapt, for this purpose, grinding machines termed cam grinders, similar to those used for example in the manufacture of camshafts for automobile engines, thread cutting taps, and router cutters, wherein the workpiece is supported on centres and rotated continuously while being cyclically moved towards and away from a grinding wheel under the action of a master cam. The required amount of stock is progressively removed by infeeding of the grinding wheel during many revolutions of the workpiece. As in the case of chamfer grinding machines, a large diameter grinding wheel is used, which makes it impossible to grind that part of the metering edge contour towards the centre-line of the groove where increasing depth would cause the grinding wheel to interfere with the opposite edge of the same groove. This steeply sloping and relatively deep portion of the input-shaft metering edge contour will henceforth be referred to as the "inner" metering edge contour and its geometry generally affects the on-centre region of the valve pressure characteristic. This portion is generally manufactured by means other than the chamfer or cam grinding machines just described which, for reasons stated, are only capable of grinding the "outer" metering edge contour. This previously described gently sloping wedge shaped portion of the metering edge contour determines the valve pressure characteristic at medium and high operating pressures, as well as determining the valve noise characteristic.

In the case of both chamfer and cam grinding methods described, the outside diameter of the hardened input-shaft is usually cylindrically ground on centres in an operation immediately prior to grinding the outer metering edge contours on these same centres. This is required because these centres are necessarily turned in the ends of the input-shaft workpiece prior to hardening and hence are no longer concentric with respect to its outside diameter after hardening, due to metallurgical distortion. However, for the same reasons, this method of processing inevitably results in the array of input-shaft grooves, machined on the same centres by milling or hobbing methods prior to hardening, being eccentric with respect to the input-shaft outside diameter.

Present manufacturers who chamfer grind metering edge contours by the methodology just described frequently true the sides of the axially extending input-shaft grooves using a small diameter, high speed grinding wheel, which is plunged radially into each groove. Such a truing operation, however, is not feasible in the case of cam grinding machines. Another method sometimes used to true the resulting eccentricity of the grooves after hardening is to re-true the centres in the input-shaft workpiece immediately after hardening by colleting the input-shaft in a fixture which locates on the outside diameter of the input-shaft adjacent to the grooves. Such re-trued centres can then be reliably used for subsequent cylindrical grinding of the outside diameter of the input-shaft as well as for grinding the metering edge contours. Whichever method is used for correcting the eccentricity of the array of input-shaft grooves, however, results in significant increases in time and therefore cost in the processing.

However the major disadvantage of processing both the input-shaft outside diameter and metering edge contours on centres is that the former of these two steps, that is cylindrically grinding the outside diameter of the input-shaft on centres, is much less efficient than the more commonly used centreless cylindrical grinding process. Centreless cylindrical grinding is generally more highly accurate than cylindrical grinding on centres, and can be readily implemented as a "through feed" or continuous process, leading to much reduced overall cycle times. Moreover, the expected accuracy gains of processing both the input-shaft outside diameter and the metering edge contours on centres may not always eventuate, and the array of metering edge contours may still be eccentric with respect to the input-shaft outside diameter. This residual eccentricity can be caused by damage to the fragile female centres of the input-shaft workpiece which are typically non-hardened.

It is apparent that many of the disadvantages of processing the hardened input-shaft on centres could be overcome by carrying out all such post-hardening operations in a centreless manner: that is centreless cylindrically grinding of the input-shaft outside diameter followed by centreless grinding of the metering edge contours. In the latter process the so-called control wheel would be moved in and out during grinding in a manner co-ordinated with the rotation of the input-shaft, so progressively grinding all contours around the outside periphery of the input-shaft. However, as referred to earlier, it is a necessary requirement that the valve operating angle be closely controlled, and the angular disposition of the points of intersection of the metering edge contour and the input-shaft outside diameter also accurately maintained. By using such a centreless grinding method for the input-shaft metering edge contours, the depth of any contour being ground would be determined by the distance between such contour and the diametrically opposite portion of the input-shaft outside diameter (corresponding to the point of contact with the control wheel). The depths of the metering edge contours so ground would vary not only in accordance with any errors in the contour grinding operation but also, in addition, absolute diametral errors resulting from the prior centreless grinding cylindrical operation carried out on the input-shaft outside diameter.

As far as is known such centreless grinding of metering edge contours has never been carried out commercially, perhaps due to this limitation associated with compounding of the errors.

SUMMARY OF THE INVENTION

The present invention involves a method of supporting of the input-shaft during centreless grinding of the metering edge contours and enables the metering edge contours to be accurately disposed with respect to the immediate outside diameter of the input-shaft, as compared to the diametrically opposite portion of the outside diameter. Absolute depths and angular dispositions of the metering edge contours can therefore be maintained without the compounding of errors earlier referred to. It is therefore possible to take full advantage of the benefits of centreless processing of the input-shaft.

The present invention consists in a machine for grinding the metering edge contours on edges of axially extending grooves of a power steering valve input-shaft having support means for supporting the input-shaft for rotation, a substantially cylindrical grinding wheel whose working surface is dressed parallel to the axis of the input-shaft, drive means to rotate the input-shaft, means to increase and decrease cyclically the distance between the axis of the input-shaft and the grinding wheel several times during each revolution of the input-shaft to grind the metering edge contours, each metering edge contour so ground having a contour which is a mirror image of the contour of at least one other metering edge contour around the periphery of the input-shaft, producing symmetrical sets of clockwise and anticlockwise metering edge contours characterised in that the support means comprises support surfaces tangentially contacting the outside diameter of the input-shaft, a first two of the support surfaces being axially displaced on either side of the ends of the grooves, and being arranged one on each side of the grinding wheel on that side of the input-shaft adjacent said the grinding wheel and another the support surface or other the support surfaces being arranged substantially at right angles to the first two support surfaces to constrain the input-shaft against motion in a direction parallel to the first two support surfaces, a pair of pressing members contacting the outside diameter of the input-shaft, one each displaced axially either side of the ends of the grooves and loaded so as to press the input-shaft in a direction generally towards the first two support surfaces, thereby centrelessly supporting the input-shaft during grinding of the metering edge contours.

A further advantage of using the machine just described relates to the widely used practice of selective assembly during manufacture of power steering valves. Because of the need to very closely control the diametral fit between the input-shaft and its surrounding sleeve member (typically between 0.007 and 0.012 mm on diameter), it is common practice to manufacture both sleeve and input-shaft over a somewhat larger diametral range of about 0.025 mm and subsequently selectively match the pairs during the valve assembly operation. By using the centreless grinding machine having supports as taught in the invention, a precise disposition of the metering edge contours is achieved, irrespective of the absolute diameter of the particular input-shaft being ground. This is not possible with prior art methods described earlier wherein the grinding operation would require to be continually adjusted in depth in order to ensure a precise angular disposition of the metering edge contours. Also, eccentricity errors between the outside diameter of the input-shaft and the metering edge contours are eliminated.

DESCRIPTION OF THE DRAWINGS

The present invention will now be described by way of example with reference to the accompanying drawings in which.

DESCRIPTION OF THE PREFERRED EMBODIMENTS

Figure 1:
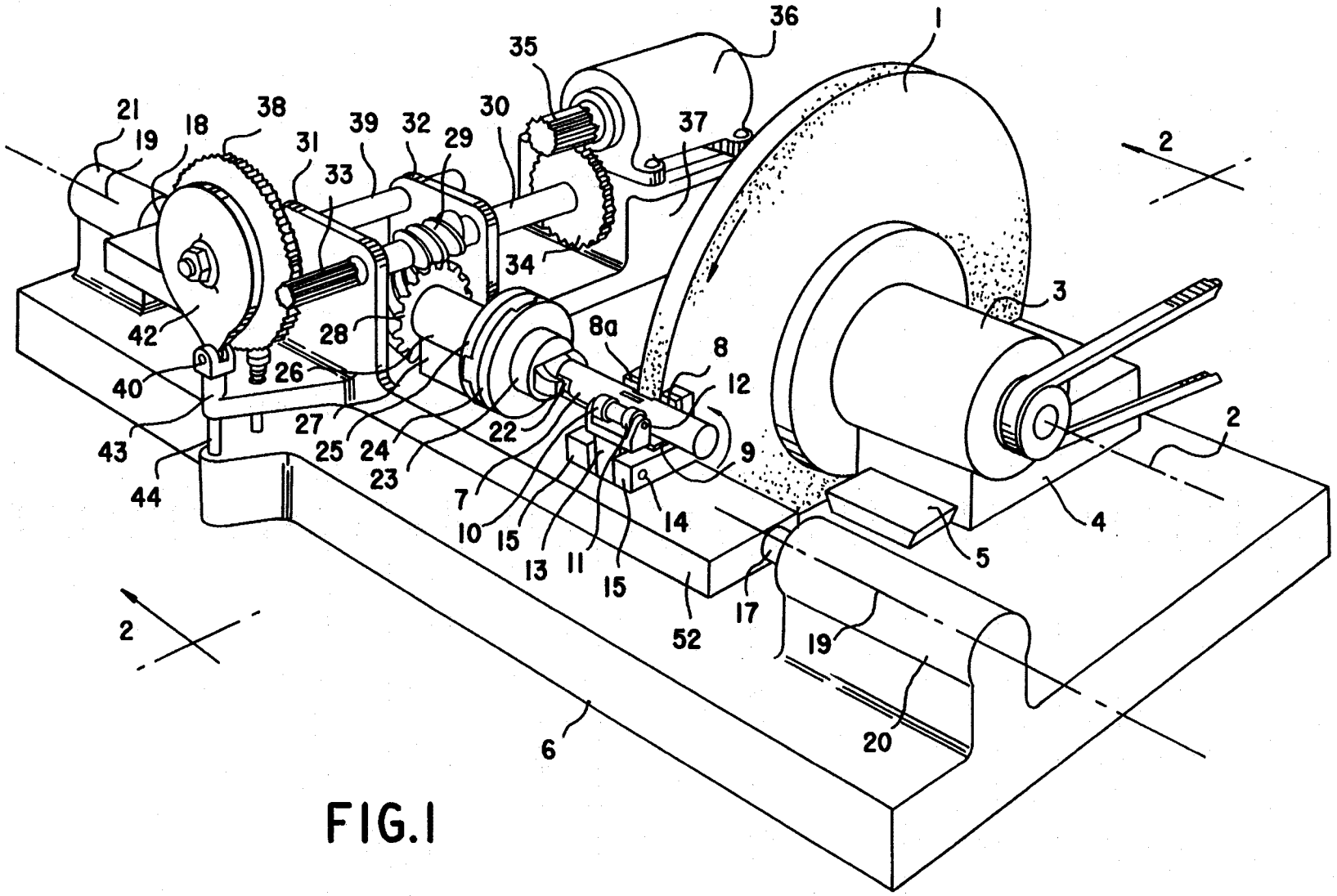
FIG. 1 is a,three dimensional perspective view of the overall grinding machine.

FIG. 1 shows schematically the principal features of the grinding machine in which grinding wheel 1 is mounted on a spindle having an axis 2 housed in journal 3 carried on slide 4 operable in slideway 5 which forms part of machine base 6.

Figure 2:
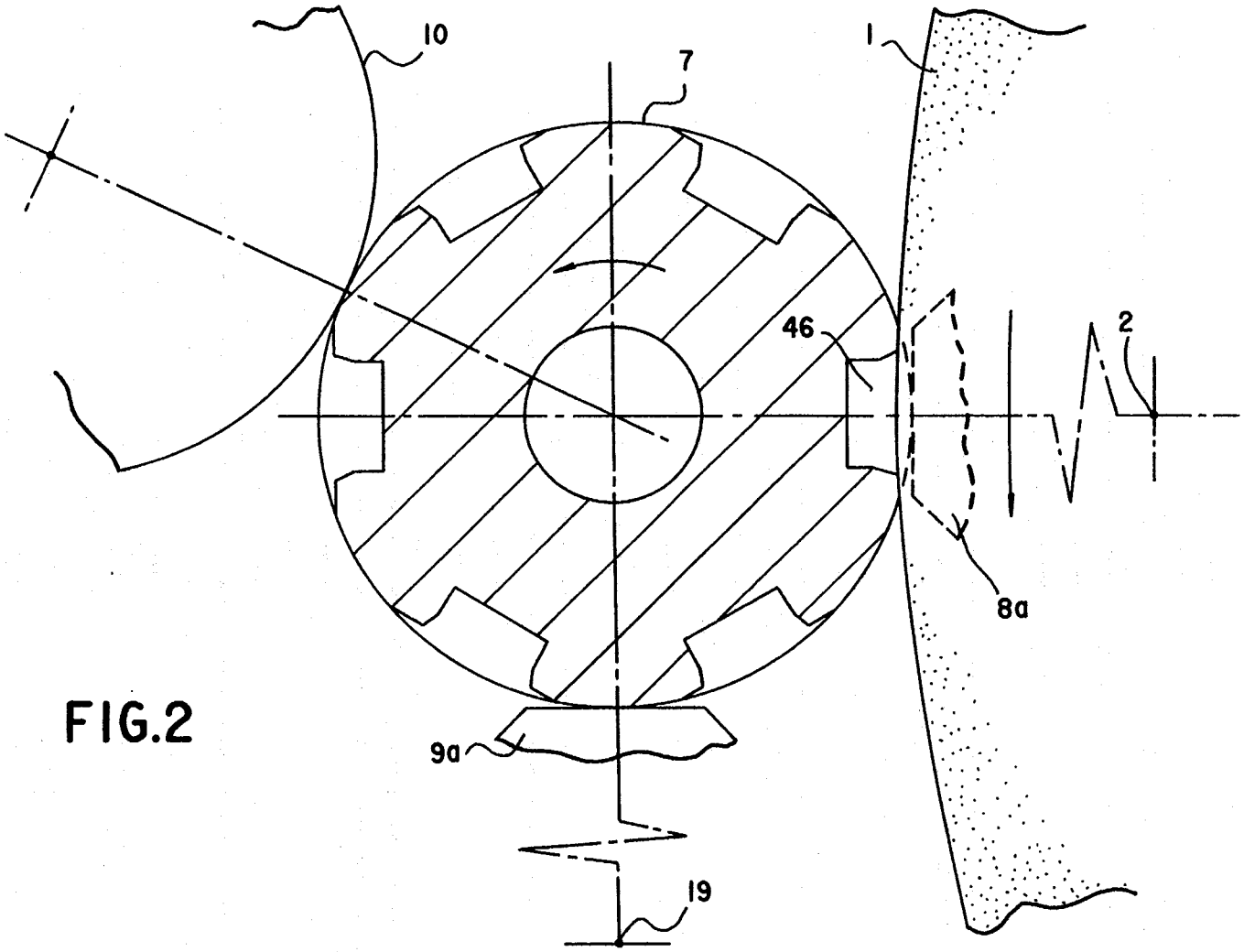
FIG. 2 is a magnified sectional view on plane DD in FIG. 1 normal to the input-shaft axis showing the method of support of the input-shaft in the grinding machine.
Figure 3:
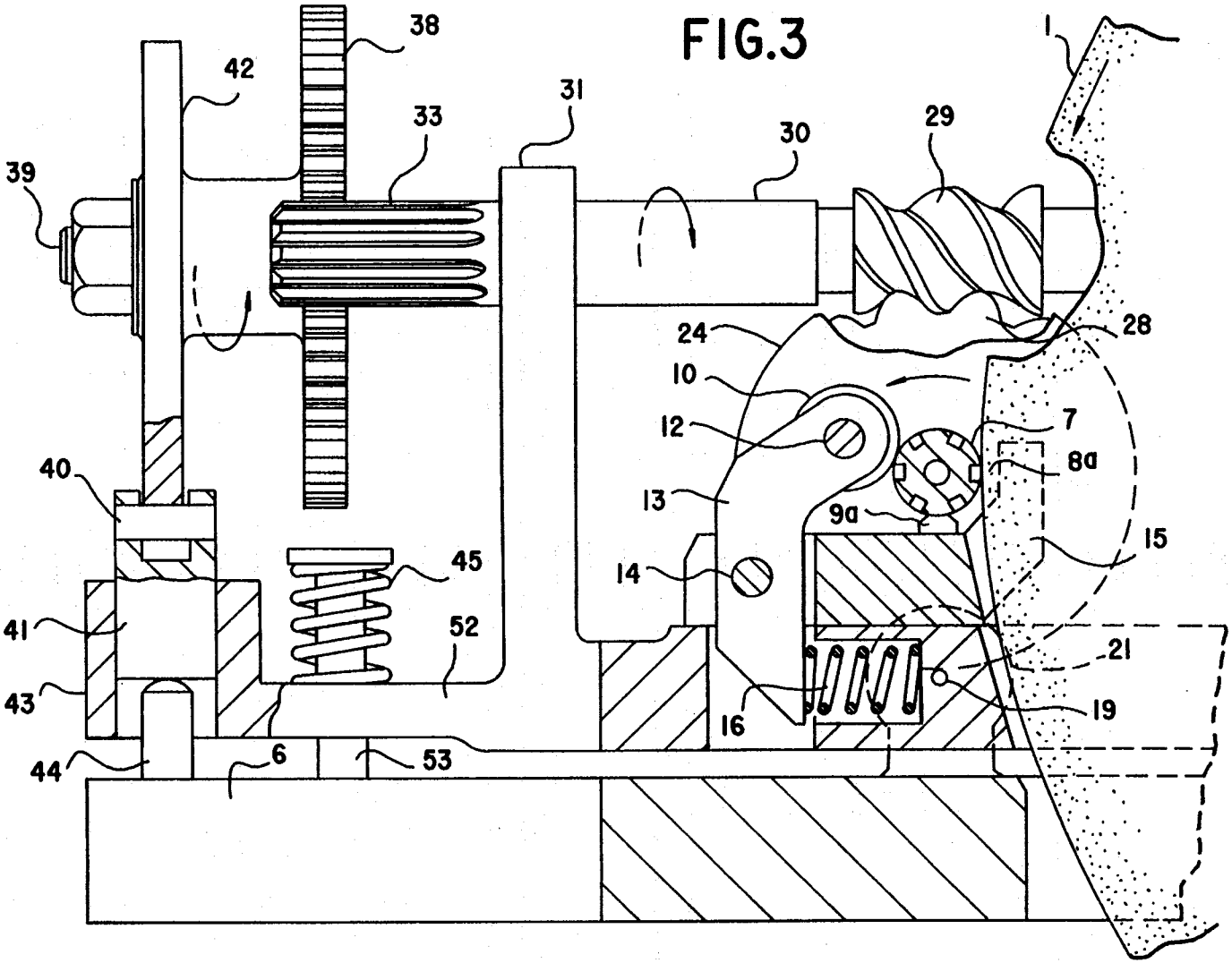
FIG. 3 is a sectional view on plane DD in FIG. 1 of the grinding machine.

Now referring to FIGS. 2 and 3, input-shaft 7 is supported for rotation on two pairs of wear resistant support pads, the first pair 8 and **8*a*, one on each side of the grinding wheel and axially displaced beyond the ends of the grooves, and the second pair 9 and 9*a* (obscured in FIG. 1) underneath input-shaft 7, serving to support it in a direction parallel to the faces of the first pair 8 and 8*a*. Rollers 10 and 11 are journalled on pin 12 in yoke 13 which itself is pivoted on pin 14 in forked support block 15 which also provides a mounting for support pads 8, 8*a*, 9 and 9*a*. Spring 16 serves to maintain pressure between rollers 10 and ! 1 and the outside diameter of input-shaft 7, yet allows yoke 13 to be pulled back in order to remove input-shaft 7 on completion of the grinding operation. Forked support block 15 is secured to rocking platform 52 which is journalled for oscillation about pivots 17 and 18, that is about axis 19. Pivots 17 and 18 are carried by pedestals 20 and 21 respectively, which form part of machine base 6**.

Input-shaft 7 has two flats 22 machined thereon which are gripped by the two jaws of chuck 23 which are hinged on the front of disc 24 of an Oldham coupling, the rear member which comprises flange 25 of main work spindle 26. The manner of opening and closing the jaws of chuck 23 is conventional. Main work spindle 26 is journalled on pedestal 27 which forms part of rocking platform 52 and is rotated by worm wheel 28 secured thereon. Worm 29 integral with worm shaft 30, engages worm wheel 28 in a slack free manner and is journalled for rotation but restrained from axial sliding in journal plates 31 and 32 extending vertically from rocking platform 52. Worm shaft 30 extends forwardly of journal plate 31 (in FIG. 1) and has pinion teeth 33 cut thereon, and extends rearwardly of journal plate 32 support gear 34 which engages pinion 35 of motor 36. Motor 36 is mounted on bracket 37 which forms an integral part of rocking platform 52 and therefore oscillates therewith about pivots 17 and 18. Gear 38 is carried on shaft 39 and meshes with pinion teeth 33 of worm shaft 30. Shaft 39 is also journalled for rotation in journal plates 31 and 32, but restrained from axial sliding therein.

The ratios of pinion teeth 33, gear 38, worm 29 and worm wheel 28 are such that when grinding a six groove input-shaft, shaft 39 makes six revolutions for one revolution of main work spindle 26.

Figure 4:
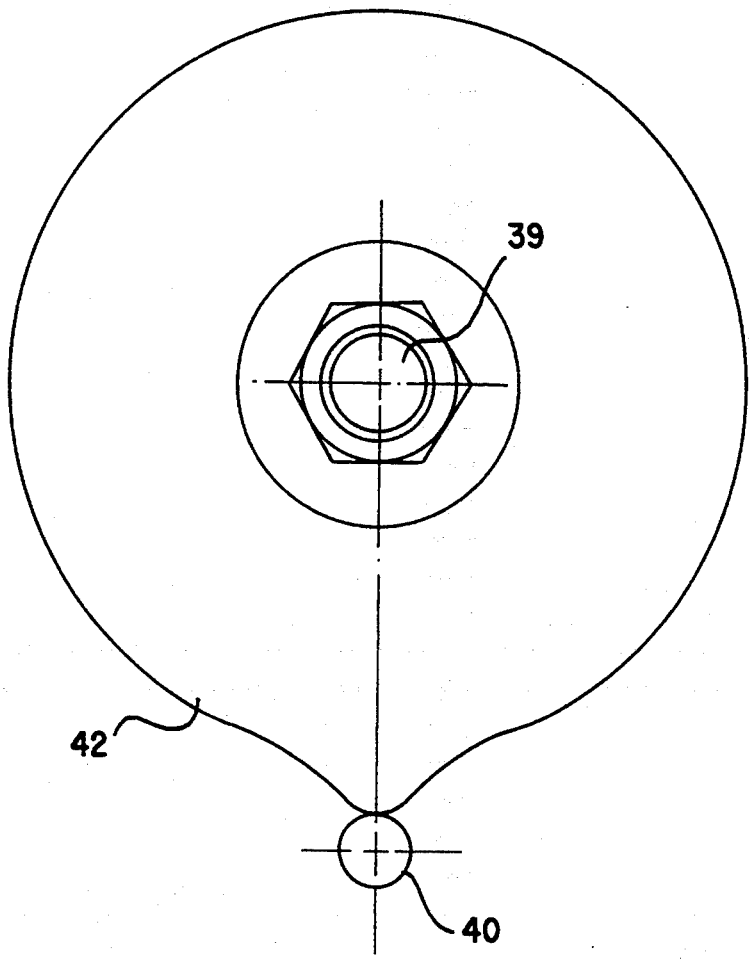
FIG. 4 is a view of a cam shown in FIG. 1 normal to its axis.

Cam 42 contacts follower pin 40 journalled in slider 41 within boss 43 extending from rocking platform 52. At its lower end slider 41 rests on pin 44 secured to machine base 6. Spring 45, also secured to machine base 6 by headed pin 53, keeps cam 42 in contact with follower pin 40 and slider 41 in contact with pin 44, and assures a positive, slack-free oscillation of rocking platform 52 in accordance with the lobed profile of cam 42 (see detail in FIG. 4).

Upon starting motor 36, main work spindle 26 and input-shaft 7 commence to rotate in the direction shown and slide 4 immediately feeds in a small amount in order to commence grinding input-shaft 7. The width of grinding wheel 1 is such as to grind the entire width of the metering edge contour.

Figure 5:
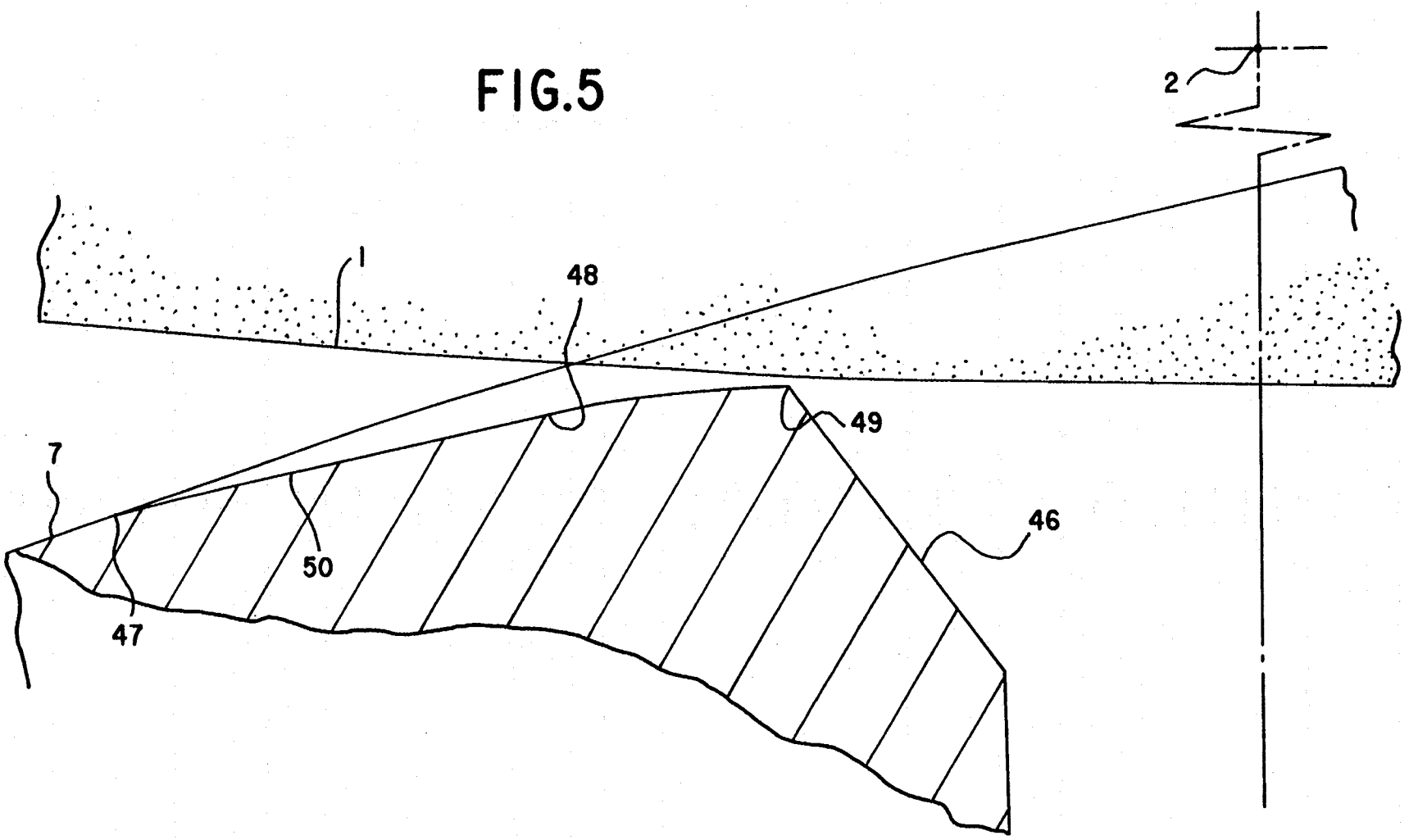
FIG. 5 is an enlarged view of the metering edge contour ground on the edge of one input-shaft groove.

FIG. 5 shows, at a greatly enlarged scale, the position earlier shown in FIG. 2 in which one of the previously machined axially extending grooves 46 is aligned with the axis 2 of grinding wheel 1. The profile of cam 42 is such that grinding wheel 1 has produced a substantially flat metering edge contour between points 47 and 48 and a scroll-like metering edge contour between points 48 and 49. Point 50 corresponds to the point on the metering edge contour with a depth of 0.012 mm, normally associated with the generation of maximum parking pressures in the valve.

Cam 42 revolves six times to complete all 12 metering edge contours of a six groove input-shaft (as illustrated) or eight times to complete all 16 metering edge contours of an eight groove input-shaft (not shown).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A machine for grinding the metering edge contours on edges of axially extending grooves of a power steering valve input-shaft, said machine comprising:

support means for supporting said input-shaft for rotation;

a substantially cylindrical grinding wheel whose working surface is dressed parallel to axis of said input-shaft;

drive means for rotating said input-shaft;

means for cyclically increasing and decreasing a distance between said axis of said input-shaft and said grinding wheel several times during each revolution of said input-shaft to grind said metering edge contours, wherein each said metering edge contour ground to have a contour which is a mirror image of the contour of at least one other metering edge contour around the periphery of said input-shaft, therein forming metering edge contours, wherein said support means includes support surfaces which tangentially contact an outside diameter of said input-shaft, a first two of said support surfaces being axially displaced on either side of ends of said grooves, and being arranged one on each side of said grinding wheel on a side of the input-shaft adjacent said grinding wheel and other said support surfaces being arranged substantially at right angles to said first two support surfaces to constrain the input-shaft against motion in a direction parallel to said first two support surfaces, and a pair of pressing members contacting said outside diameter of the input-shaft, one each displaced axially on either side of the ends of said grooves and loaded so as to press said input-shaft in a direction generally towards said first two support surfaces, therein centerlessly supporting the input-shaft during grinding of the metering edge contours.

2. A machine as claimed in claim 1 in which said pressing members comprise two rollers pivoted on a longitudinal axis parallel to said axis of said input-shaft.

3. A machine as claimed in claim 1 in which said means for cyclically increasing and decreasing said distance between said input-shaft and said grinding wheel comprises a moving means incorporating said support surfaces, said moving means being arranged to move about a longitudinal axis which is parallel to said axis of said input-shaft and which is displaced therefrom at right angles to a plane containing said axis of said input-shaft and a rotational axis of said grinding wheel, rotatable cam means arranged for synchronous rotation with said drive means, follower means for engaging said cam means and said follower means, connected to said moving means, to move said moving means cyclically in synchronism with said rotation of said input-shaft.

* * * * *

UNITED STATES PATENT AND TRADEMARK OFFICE

CERTIFICATE OF CORRECTION

PATENT NO. :5,439,412
DATED :August 8, 1995
INVENTOR(S) :Arthur E. Bishop

It is certified that error appears in the above-indentified patent and that said Letters Patent is hereby corrected as shown below:

Title page, [*] Notice, line 2, should read--The term of this patent shall not extend beyond the expiration date of Pat. No. 5,299,388--.

Signed and Sealed this

Thirtieth Day of January, 1996

*Attest:*

Bruce Lehman

BRUCE LEHMAN

*Attesting Officer*

*Commissioner of Patents and Trademarks*